US008606521B2

(12) United States Patent
Beisel et al.

(10) Patent No.: US 8,606,521 B2
(45) Date of Patent: Dec. 10, 2013

(54) DETERMINING FLUID PRESSURE

(75) Inventors: Joseph A. Beisel, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 599 days.

(21) Appl. No.: 12/707,306

(22) Filed: Feb. 17, 2010

(65) Prior Publication Data

US 2011/0202275 A1 Aug. 18, 2011

(51) Int. Cl.
*G01V 9/00* (2006.01)

(52) U.S. Cl.
USPC ..... 702/6; 702/12; 702/45; 702/50; 702/137; 702/138; 73/152.01; 73/152.03; 73/152.05; 73/152.09

(58) Field of Classification Search
USPC ..... 702/3, 6, 12
See application file for complete search history.

(56) References Cited

U.S. PATENT DOCUMENTS

| | | | | |
|---|---|---|---|---|
| 4,513,625 | A * | 4/1985 | Campman et al. | 73/861.72 |
| 4,522,068 | A * | 6/1985 | Smith | 73/32 A |
| 4,779,186 | A * | 10/1988 | Handke et al. | 700/67 |
| 5,609,576 | A * | 3/1997 | Voss et al. | 604/67 |
| 6,002,985 | A | 12/1999 | Stephenson | |
| 6,347,283 | B1 | 2/2002 | Soliman et al. | |
| 6,959,609 | B2 | 11/2005 | Stephenson | |
| 7,100,688 | B2 | 9/2006 | Stephenson et al. | |
| 2005/0016292 | A1 * | 1/2005 | Dutton et al. | 73/861.03 |
| 2005/0044929 | A1 * | 3/2005 | Gysling et al. | 73/32 A |
| 2007/0150547 | A1 * | 6/2007 | Cook et al. | 709/212 |
| 2008/0034893 | A1 * | 2/2008 | Stappert et al. | 73/861.356 |
| 2008/0262783 | A1 * | 10/2008 | Alexander Lambert | 702/137 |
| 2010/0046316 | A1 * | 2/2010 | Hughes et al. | 366/8 |

OTHER PUBLICATIONS

Bamberger, J.A. & Greenwood, M.S., "Measuring fluid and slurry density and solids concentration non-invasively", 2004, Elsevier B.V., Ultrasonics 42, pp. 563-567, doi:10.1016/j.ultras.2004.01.032.*

Hylton, T.D., "An Evaluation of a Dual Coriolis Meter System for In-Line Monitoring of Suspended Solids Concentrations in Radioactive Slurries", Sep. 2000, Oak Ridge National Laboratory, ORNL/TM-2000/184, pp. 1-56.*

The Engineering ToolBox, "Slurry-Density, Calculating density of slurries", no date, accessed online Mar. 2012, http://www.engineeringtoolbox.com/slurry-density-d_1188.html, pp. 1-2.*

Flygt ITT Industries, "Slurry handbook Guidelines for slurry pumping", no date, ITT Industries, pp. 1-48.*

(Continued)

*Primary Examiner* — Mischita Henson
(74) *Attorney, Agent, or Firm* — Robert A. Kent; Fish & Richardson P.C.

(57) ABSTRACT

A wellbore fluid pressure measurement system includes a densometer adapted to measure a fluid density of a fluid flowing in a tubing system; and a monitoring unit communicably coupled to the densometer. The monitoring unit is adapted to receive a plurality of values representative of the fluid density from the densometer and includes a memory adapted to store the plurality of values representative of the fluid density; and one or more processors operable to execute a fluid pressure measurement module. The module is operable when executed to determine a fluid pressure of the fluid based on at least a portion of the values representative of the fluid density.

31 Claims, 10 Drawing Sheets

(56) References Cited

OTHER PUBLICATIONS

Stappert, "Coriolis Mass Flaw Meters for Natural Gas Measurement," publicly available Mar. 7, 2005, downloaded from http://www.documentation.emersonprocess.com/ on Jun. 19, 2012 (11 pages).

Floyd, "Measurement of Natural Gas by Coriolis Meter," AGA Report No. 11 Revised, publicly available Apr. 2, 2012, downloaded from http://www.documentation.emersonprocess.com/ on Jun. 19, 2012 (7 pages).

* cited by examiner

DETERMINING FLUID PRESSURE

TECHNICAL BACKGROUND

This disclosure relates to determining a fluid pressure through one or more dcnsomctcrs.

BACKGROUND

Wellbore fluid pressure, such as fluid pressure generated by a fracturing ("fracing") fluid, drilling fluid, or other fluid, may be monitored for a variety of reasons. For example, a tubing, or "iron," system in place in the wellbore may have a maximum pressure rating. The wellbore fluid pressure may be monitored to ensure that it does not exceed and/or approach the maximum pressure rating. As another example, particular components of or coupled to the tubing system, such as a wellhead, pumps, fitting (e.g., valves or otherwise) may also have corresponding maximum pressure ratings. As such, the wellbore fluid pressure may be monitored to ensure that it does not exceed these maximum pressure ratings. In certain instances, a degree to which the wellbore fluid pressure approaches and/or exceeds a maximum pressure rating may dictate any number of remedial actions. For example, if the wellbore fluid pressure approaches but does not exceed the maximum pressure rating, the tubing system may merely be subjected to a subsequent pressure test to ensure that no permanent damage has occurred. But as the wellbore fluid pressure exceeds or begins to exceed the maximum pressure rating (e.g., an overpressure situation), one or more components of the tubing system, such as the pumps, may be taken apart and/or tested, thus causing delay in a completion and/or drilling operation. Even further, should the wellbore fluid pressure increasingly exceed the maximum pressure rating, the tubing system and/or components thereof (e.g., pumps, wellhead) may be damaged beyond repair.

In certain instances, one or more pressure transducers may be supplied at or in the tubing system to monitor the wellbore fluid pressure, such as during a fracing operation. Pressure transducers may provide an efficient and relatively simple technique for measuring the wellbore fluid pressure and providing a signal representative of the pressure to a control center, operator, command center (e.g., fracing truck or other pumping truck) or other location. In certain instances, the pressure signal may be lost or unavailable due to various reasons. For example, the pressure transducer may fail or lose communication with the control center or other location. In certain instances, the pressUre transducer may be operational but may have a maximum rating less than the wellbore fluid pressure in the tubing system. For instance, the pressure transducer may have a maximum rating of 15,000 psi. If the fluid pressure exceeds this amount, the pressure signal may only provide a signal representative of this maximum rating rather than the true fluid pressure. While pressure transducers may be available with higher maximum ratings, such transducers may have lower and/or unacceptable granularity or may be cost prohibitive.

In certain instances, the fluid pressure may also be determined from calculations involving integrating a fluid flow rate (e.g., the flow rate of a fracing or drilling fluid) and determining the fluid volume added to the wellbore (assumed to be sealed). This method, however, may require knowledge of an effective bulk modulus of the fluid, which may be difficult to determine and/or estimate. Also, other fluid pressure effects, such as water hammer, may not be included in this method. Thus, such a technique may not accurately calculate the fluid pressure.

SUMMARY

In one general embodiment, a computer implemented method of determining a wellbore fluid pressure includes receiving, at a computer, a signal from a densometer representative of a density of a fluid flowing through a wellbore; and determining, by the computer, a fluid pressure of the fluid based at least in part on the signal.

In another general embodiment, a computer program product for determining a wellbore fluid pressure includes computer readable instructions embodied on tangible media that are operable when executed to receive a signal from a densometer representative of a density of a fluid flowing through a wellbore; and determine a fluid pressure of the fluid based at least in part on the signal.

In another general embodiment, a wellbore fluid pressure measurement system includes a densometer adapted to measure a fluid density of a fluid flowing in a tubing system; and a monitoring unit communicably coupled to the densometer. The monitoring unit is adapted to receive a plurality of values representative of the fluid density from the densometer and includes a memory adapted to store the plurality of values representative of the fluid density; and one or more processors operable to execute a fluid pressure measurement module. The module is operable when executed to determine a fluid pressure of the fluid based on at least a portion of the values representative of the fluid density.

In a specific aspect of one or more of these general embodiments, the signal may include a plurality of values representative of the density of the fluid, and determining, by the computer, a fluid pressure of the fluid based at least in part on the signal may include determining, by the computer, a fluid pressure of the fluid based on at least a portion of the values representative of the density of the fluid.

In a specific aspect of one or more of these general embodiments, the fluid may be a slurry having a fluid component and a solid component.

In a specific aspect of one or more of these general embodiments, determining a fluid pressure of the fluid based at least in part on the signal may include correcting the signal representative of the fluid density based on a concentration of the solid component in the slurry.

In a specific aspect of one or more of these general embodiments, correcting the signal representative of the fluid density based on a concentration of the solid component in the slurry may include correcting the signal representative of the fluid density based on the equation $$\rho_{fluid} = C_{prop}\left[\rho_{slurry}\left(\frac{1}{\rho_{prop}} + \frac{1}{C_{prop}}\right) - 1\right]$$

where $\rho_{fluid}$ is the corrected signal representative of the fluid density; $C_{prop}$ is the concentration of the solid component in the slurry in lbs of solid per gallon of fluid; $\rho_{prop}$ is an absolute density of the solid component in the slurry; and $\rho_{slurry}$ is a density of the fluid.

In a specific aspect of one or more of these general embodiments, determining a fluid pressure of the fluid based at least in part on the signal may include scaling the corrected signal representative of the fluid density to determine the fluid pressure of the fluid.

In a specific aspect of one or more of these general embodiments, scaling the corrected signal representative of the fluid density to determine the fluid pressure of the fluid may include one or more of: empirically scaling the corrected signal representative of the fluid density to determine the fluid pressure of the fluid; and quantitatively scaling the corrected signal representative of the fluid density to determine the fluid pressure of the fluid.

In a specific aspect of one or more of these general embodiments, empirically scaling the corrected signal representative of the fluid density to determine the fluid pressure of the fluid may include scaling the corrected signal representative of the fluid density as a function of the fluid density and one or more empirically derived constants.

In a specific aspect of one or more of these general embodiments, scaling the corrected signal representative of the fluid density as a function of the fluid density and one or more empirically derived constants may include scaling the corrected signal representative of the fluid density according to the equation:

$$P=C_1*\rho_{fluid}^3-C_2$$

where P is the is the determined fluid pressure of the fluid; $\rho_{fluid}$ is the fluid density; and $C_1$ and $C_2$ are empirically derived constants.

In a specific aspect of one or more of these general embodiments, one or both of $C_1$ and $C_2$ may be determined based at least in part on a particular combination of densometer and pressure transducer.

In a specific aspect of one or more of these general embodiments, quantitatively scaling the corrected signal representative of the fluid density to determine the fluid pressure of the fluid may include scaling the corrected signal representative of the fluid density according to a value representing a bulk modulus of the fluid.

In a specific aspect of one or more of these general embodiments, the value representing a bulk modulus of the fluid may be a non-linear value representing the bulk modulus of the fluid.

In a specific aspect of one or more of these general embodiments, quantitatively scaling the corrected signal representative of the fluid density to determine the fluid pressure of the fluid may include scaling the corrected signal according to the equation:

$$P = m*\beta\left(1-\frac{\rho_1}{\rho_2}\right)+b$$

where P is the determined fluid pressure of the fluid; $\rho_1$ is a density of the fluid with zero system gauge pressure; $\rho_2$ is an instant fluid density; m is a gain factor constant; and b is an offset constant.

A specific aspect of one or more of these general embodiments may further include comparing the fluid pressure to a predefined pressure; determining that the fluid pressure exceeds the predefined pressure; and initiating a remedial action based at least in part on the determination that the fluid pressure exceeds the predefined pressure.

In a specific aspect of one or more of these general embodiments, initiating a remedial action based at least in part on the determination that the fluid pressure exceeds the predefined pressure may include at least one of setting an alarm indicating that the fluid pressure exceeds the predefined pressure; and stopping one or more pumping units providing at least a portion of the fluid to the wellbore.

In a specific aspect of one or more of these general embodiments, empirically scaling the portion of the values representative of the fluid density to determine the fluid pressure of the fluid may include curve fitting the portion of the values representative of the fluid density to a curve representing measure fluid pressure values.

Various aspects and/or embodiments of a system including a fluid measuring module receiving one or more signals from a densometer to determine a fluid pressure according to the present disclosure may include one or more of the following features. For example, the system may allow a maximum wellbore fluid pressure to be determined if a pressure transducer fails and/or is disabled. The system may also allow a maximum wellbore fluid pressure to be determined if such pressure exceeds a maximum pressure rating of a pressure transducer. The system may also provide an independent wellbore fluid pressure measurement technique. The system utilizing one or more signals from a densometer may also provide a cost efficient technique for measuring a wellbore fluid pressure without adding substantially any hardware and/or devices to a completion assembly.

Various aspects and/or embodiments of a system including a fluid measuring module receiving one or more signals from a densometer to determine a fluid pressure according to the present disclosure may include one or more of the following features. For example, the system may also determine a maximum wellbore fluid pressure in the event of an overpressure situation. The system may at least partially determine if an overpressure event exceeds a maximum pressure rating of one or more wellsite components. The system may also determine to what degree an overpressure event exceeds a maximum pressure rating of one or more wellsite components.

These general and specific aspects may he implemented using a device, system or method, or any combinations of devices, systems, or methods. The details of one or more embodiments are set forth in the accompanying drawings and the description below. Other features, objects, and advantages will he apparent from the description and drawings, and from the claims.

DETAILED DESCRIPTION

In some embodiments, signals transmitted and/or stored by a densometer located within a fluid conduit system proximate a wellbore may be received and manipulated to determine a corresponding fluid pressure of a fluid transported via the conduit system. In certain instances, the densometer may provide a backup or alternative to a pressure sensor in the conduit system, for example, when the pressure sensor has failed, the fluid pressure is outside of the pressure sensor operating range and/or in other instances. The signals representative of fluid density may be corrected to account for a concentration of solid particles within the fluid. In some aspects, the signals representative of fluid density may be empirically scaled (e.g., curve fit) to known, calibrated pressure transducer measurements within an operable range of the transducer in order to derive fluid pressure from fluid density. In some aspects, the signals representative of fluid density may be quantitatively scaled according to one or more equations and/or curve fits related to a bulk modulus (constant or variable) of the fluid in order to derive fluid pressure from fluid density. The scaled values representing fluid pressure may be used, for example, to determine whether a maximum fluid pressure in the conduit system exceeds a measurable value of the transducer and/or a maximum rating of one or more conduit system components. The scaled values representing fluid pressure may be used to initiate an action (remedial or otherwise) within the fluid conduit system.

Figure 1:
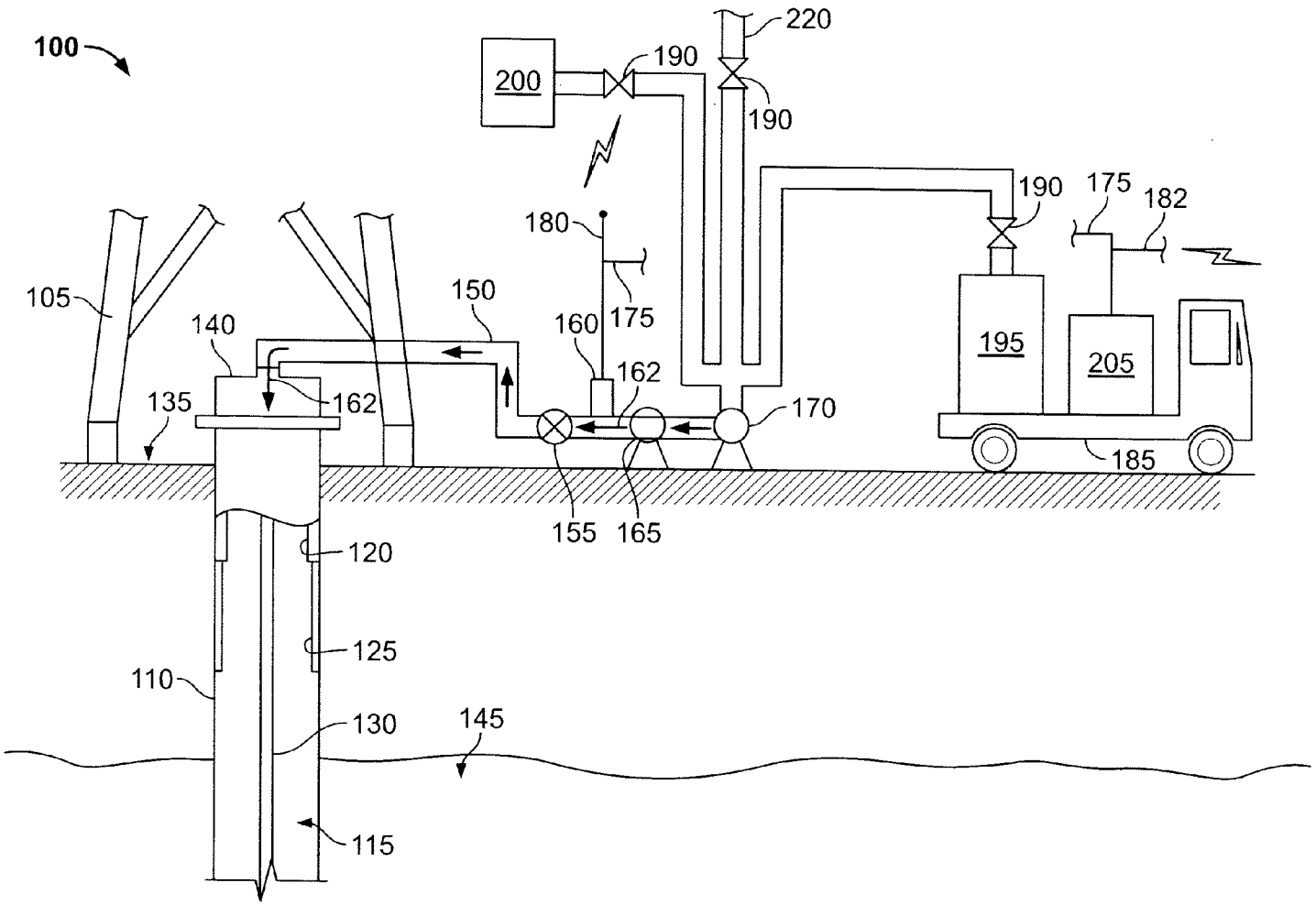
FIG. 1 illustrates one embodiment of at least a portion or a wellsite assembly including a densometer in accordance with the present disclosure.

FIG. 1 illustrates one embodiment of at least a portion of a wellsite assembly 100 including a densometer 160 in the context of a fracturing operation. A wellbore 110 is formed from a terrancan surface 135 to and/or through a subterranean zone 145. The illustrated wellsite assembly 100 includes a drilling rig 105; a tubing system 150 coupled to a fluid valve 155, a pump 165, a mixer 170, and a liquid source 220; a densometer 160 coupled to the tubing system 150; and a frac fluid truck 185 coupled to the tubing system 150. In some aspects, the wellsite assembly 100 may utilize the densometer 160 to provide one or more measurements representative of a density of a fluid flowing through the tubing system 150 in order to measure and/or monitor a fluid pressure of the fluid in the tubing system 150. Although illustrated as onshore, the wellsite assembly 100 and/or wellbore 110 can alternatively be offshore or elsewhere.

The wellbore 110, at least a portion of which is illustrated in FIG. 1, extends to and/or through one or more subterranean zones under the terranean surface 135, such as subterranean zone 145. Wellbore 110 may allow for production of one or more hydrocarbon fluids (e.g., oil, gas, a combination of oil and/or gas, or other fluid) from, for example, subterranean zone 145. The wellbore 110 is cased with one or more casings. As illustrated, the wellbore 110 includes a conductor casing 120, which extends from the terranean surface 135 shortly into the Earth. Other casing 125 is downhole of the conductor casing 120. Alternatively, some or all of the wellbore 110 can be provided without casing (i.e., open hole). Additionally, in some embodiments, the wellbore 110 may deviate from vertical (e.g., a slant wellbore or horizontal wellbore) and/or be a multilateral wellbore.

A wellhead 140 is coupled to and substantially encloses the wellbore 110 at the terranean surface 135. For example, the wellhead 140 may be the surface termination of the wellbore 110 that incorporates and/or includes facilities for installing casing hangers during the well construction phase. The wellhead 140 may also incorporate one or more techniques for hanging tubing 130, installing one or more valves, spools and fittings to direct and control the flow of fluids into and/or from the wellbore 110, and installing surface flow-control facilities in preparation for the production phase of the wellsite assembly 110.

The tubing system 150 is coupled to the wellhead 140 and, as illustrated, provides a conduit through which one or more fluids, such as fluid 162, into the wellbore 110. In certain instances, the tubing system 150 is in fluid communication with the tubing 130 extending through the wellbore 110. The fluid 162, in the illustrated embodiment of FIG. 1, is a fracing fluid introduced into the wellbore 110 to generate one or more fractures in the subterranean zone 145.

In the embodiment of FIG. 1 illustrating a fracing completion operation, the tubing system 150 is used to introduce the fluid 162 into the wellbore 110 via one or more portions of conduit and one or more flow control devices, such as the control valve 155, the pump 165, the mixer 170, one or more valves 190 (e.g., control, isolation, or otherwise), the liquid source 220, and the truck 185. Generally, the pump 165, the mixer 170, the liquid source 220, and the truck 185 are used to mix and pump a fracing fluid (i.e., fluid 162) into the wellbore 110.

The well assembly 100 includes gel source 195 and solids source 200 (e.g., a proppant source). Either or both of the gel source 195 and solids source 200 could be provided on the truck 185. Although illustrated as a "truck," truck 185 may represent another vehicle-type (e.g., tractor-trailer or other vehicle) or a non-vehicle permanent or semi-permanent structure operable to transport and/or store the gel source 195 and/or solids source 200. Further, reference to truck 185 includes reference to multiple trucks and/or vehicles and/or multiple semi-permanent or permanent structures.

The gel from the gel source 195 is combined with a hydration fluid, such as water and/or another liquid from the liquid source 220, and proppant from the solids source 200 in the mixer 170. Proppant, generally, may be particles mixed with fracturing fluid (such as the mixed gel source 195 and liquid source 220) to hold fractures open after a hydraulic fracturing treatment.

The wellsite assembly 100 also includes the densometer 160 communicably coupled to a computer 205 via a communication link 175. The link 175 may be a wired or wireless link. Generally, the densometer 160 measures the fluid density of the fluid 162 as the fluid 162 is transferred from the tubing system 150 into the wellbore 110. The densometer 160 may be the densometer provided for use in monitoring and controlling the fracturing operations (e.g., used to measure the density of the fracturing fluid flow 162 during normal fracturing operations) or an additional densometer. Although illustrated between the valve 155 controlling the flow of fluid 162 and the pump 165, the densometer 160 may be placed at other locations within the tubing system 150 and/or wellbore 110. For example, the densometer 160 may be located so as to measure the maximum fluid pressure created within the tubing system 150 and/or wellbore 110. The densometer 160, thus, may be a high pressure densometer that measures (continuously or intermittently) the density of the fluid 162.

Generally, the densometer 160 transmits one or more signals representative of the fluid density of the fluid 162 to the computer 205 via the communication link 175. As illustrated, the densometer 260 and/or computer 205 communicates all or a portion of such signals to a remote monitoring center (e.g., a home office for a vendor providing the truck 185) via communication links 180 and 182 and/or in another manner (e.g., via removable storage media). As noted above with respect to communication link 175, the links 180 and 182 may be wired or wireless links.

Notably, although the concepts described herein are discussed in connection with a fracturing operation, they could be applied to other types of operations that typically include a densitometer or that can accommodate a densitometer. For example, the wellsite assembly could be that of a cementing operation where a cementing mixture (Portland cement, polymer resin, and/or other cementing mixture) may be injected into wellbore 110 to anchor a casing, such as conductor casing 120 and/or surface casing 125, within the wellbore 110. In this situation, the fluid measured by the densitometer, as fluid 162, could be the cementing mixture. In another example, the wellsite assembly could be that of a drilling operation, including a managed pressure drilling operation, where a drill fluid is measured by the densitometer, as fluid 162. In another example, the wellsite assembly could be that of a stimulation operation, including an acid treatment, wherein the treatment fluid is measured by the densitometer, as fluid 162. Still other examples exist.

Figure 2:
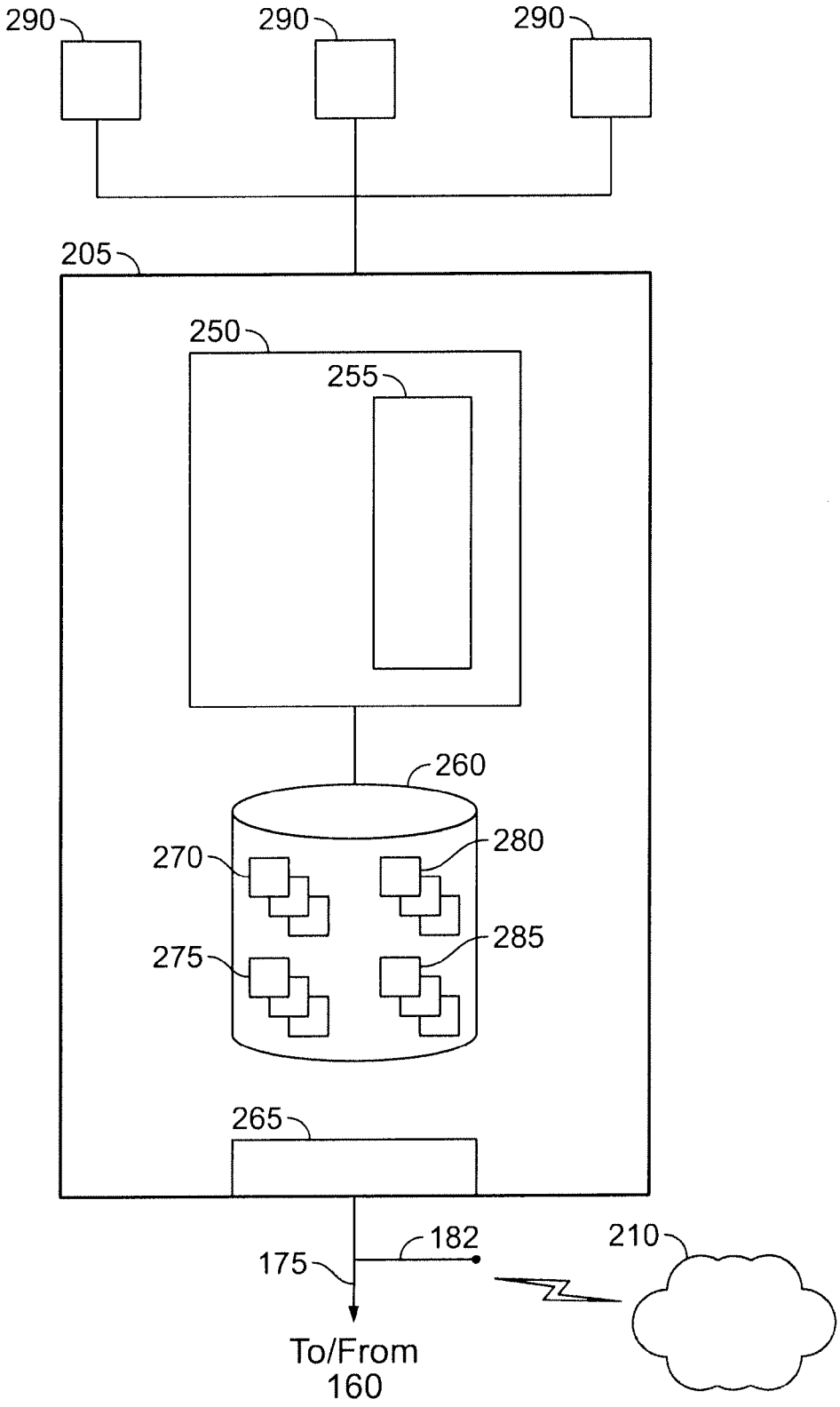
FIG. 2 illustrates one embodiment of a computer utilized at or remote from a wellsite assembly and communicatively coupled to a densometer in accordance with the present disclosure.

FIG. 2 illustrates one embodiment of the computer 205 utilized at or remote from the wellsite assembly 100 and communicatively coupled to the densometer 160. Although illustrated as located on the truck 185, for example, the computer 205 may be physically located at another location, such as remote from the wellsite assembly 100 or at the wellsite but remote from the truck 185 (e.g., at a wellsite trailer or otherwise). The computer 205 includes a processor 250 executing a fluid measuring module 255, a memory 260, a network interface 265, and one or more peripherals 290. In certain implementations, the computer 205 may be the computer used in connection with one or more operations of the well assembly 100 (e.g., data collection from the fracturing operation, controlling some or all of the gel, solids and liquid mixing, controlling some or all of the fracturing operations and/or other operations).

At a high level, the fluid measuring module 255 is executed by the processor to determine a fluid pressure of the fluid 162 based on the signals representative of the density of the fluid 162 measured by the densometer 160. More specifically, fluid measuring module 255 is any application, program, module, process, or other software that receives the signals representative of the density of the fluid 162 measured by the densometer 160, and generates, presents, and/or persists values representative of the pressure of the fluid 162. Regardless of the particular implementation, "software" may include software, firmware, wired or programmed hardware, or any combination thereof as appropriate. Indeed, fluid measuring module 255 may be written or described in any appropriate computer language including C, C++, Java, Visual Basic, assembler, Perl, any suitable version of 4GL, as well as others. It will be understood that while fluid measuring module 255 is illustrated in FIG. 2 as a single module, fluid measuring module 255 may include numerous other sub-modules or may instead be a single multi-tasked module that implements the various features and functionality through various objects, methods, or other processes. Further, while illustrated as internal to computer 205, one or more processes associated with fluid measuring module 255 may be stored, referenced, or executed remotely. For example, a portion of fluid measuring module 255 may be a web service that is remotely called, while another portion of fluid measuring module 255 may be an interface object bundled for processing at a remote client. Moreover, fluid measuring module 255 may be a child or sub-module of another software module or enterprise application (not illustrated) without departing from the scope of this disclosure.

Processor 250 is, for example, a central processing unit (CPU), a blade, an application specific integrated circuit (ASIC), or a field-programmable gate array (FPGA). Although FIG. 2 illustrates a single processor 250 in computer 205, multiple processors 250 may be used according to particular needs and reference to processor 250 is meant to include multiple processors 250 where applicable. In the illustrated embodiment, processor 250 executes fluid measuring module 255 as well as other modules as necessary. For example, the processor 250 may execute software that manages or otherwise controls the operation of the truck 185 during a completion (e.g., fracing or otherwise) operation.

Memory 260 is communicably coupled to the processor 250 and may include any memory or database module and may take the form of volatile or non-volatile memory including, without limitation, magnetic media, optical media, random access memory (RAM), read-only memory (ROM), removable media, or any other suitable local or remote memory component. Illustrated memory 260 may include one or more densometer signal values 270, one or more corrected density values 275, one or more empirically derived pressure values 280, and one or more quantitatively derived pressure values 285. But memory 120 may also include any other appropriate data such as VPN applications or services, firewall policies, a security or access log, print or other reporting files, HTML files or templates, data classes or object interfaces, child software applications or sub-systems, and others.

Interface 265 facilitates communication between computer 205 and other devices, such as the densometer 160 via link 175, or a remote monitoring location via link 182, as well as other computing systems and devices. As illustrated, the computer 205 may communicate with a remote monitoring location over network 210. Generally, interface 117 comprises logic encoded in software and/or hardware in a suitable combination and operable to communicate with network 210. More specifically, interface 265 may comprise software supporting one or more communications protocols associated with communications network 210 or hardware operable to communicate physical signals.

Network 210 facilitates wireless or wired communication between computer 205 and any other local or remote computer. Network 210 may be all or a portion of an enterprise or secured network. While illustrated as a single or continuous network, network 210 may be logically divided into various sub-nets or virtual networks without departing from the scope of this disclosure. Network 210 may communicate, for example, Internet Protocol (IP) packets, Frame Relay frames, Asynchronous Transfer Mode (ATM) cells, voice, video, data, and other suitable information between network addresses. Network 210 may include one or more local area networks (LANs), radio access networks (RANs), metropolitan area networks (MANs), wide area networks (WANs), all or a portion of the global computer network known as the Internet, and/or any other communication system or systems at one or more locations.

One or more peripheral devices 290 may be communicably coupled to and/or integral with the computer 205. For example, peripheral devices 290 may be one or more display devices (e.g., LCD, CRT, other display device); one or more data input devices (e.g., keyboard, mouse, light pin, or otherwise); one or more data storage devices (e.g., CD-ROM, DVD, flash memory, or otherwise) or other peripheral devices.

Figure 3:
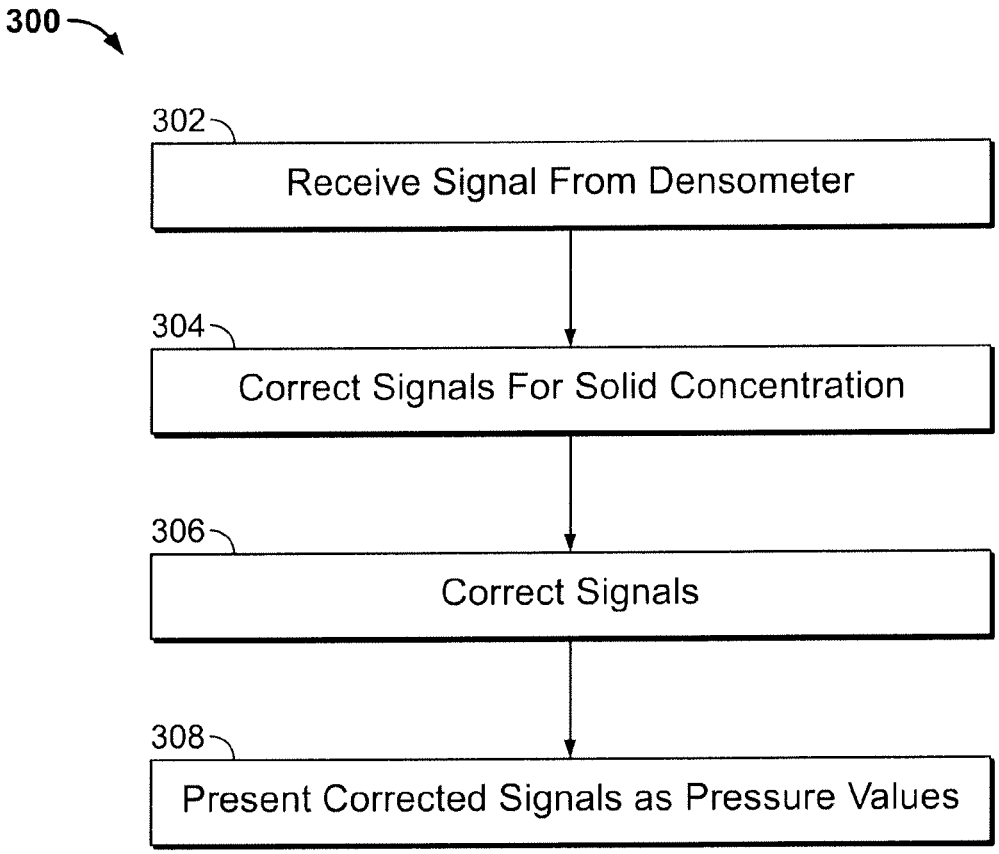
FIG. 3 illustrates one example method of utilizing a densometer to determine a fluid pressure of a fluid introduced into a wellbore in accordance with the present disclosure.

FIG. 3 illustrates one example method 300 of utilizing a densometer to determine a fluid pressure of a fluid introduced into a wellbore. In some embodiments, the method 300 may be performed by one or more components of the wellsite assembly 100. For convenience of reference, method 300 will be described performed by the fluid measurement module 255 operating on the computer 205. In other instances, all or a portion of method 300 may be performed by another device.

Method 300 begins at step 302 when one or more signals are received at the computer 205 from a densometer, such as the densometer 160. The signals are one or more densometer signals 270 representative of a density of a fluid flowing into the wellbore, such as the fluid 162. The signals 270 may be monitored for in real time and/or the signals 270 may be stored for later analysis (e.g., subsequent to completion of a frac job or other completion operation) or analyzed during a completion operation. The signals 270 may be stored for a predefined duration in the memory 260 of the computer 205 and/or in another location. In some aspects, the predefined duration may be until the completion operation is finished. Alternatively, the predefined duration may be until one or more stages of the completion operation is finished. In any event, storage of the signals 270 may be for any predefined duration according to the specific completion operation or otherwise.

Figure 4:
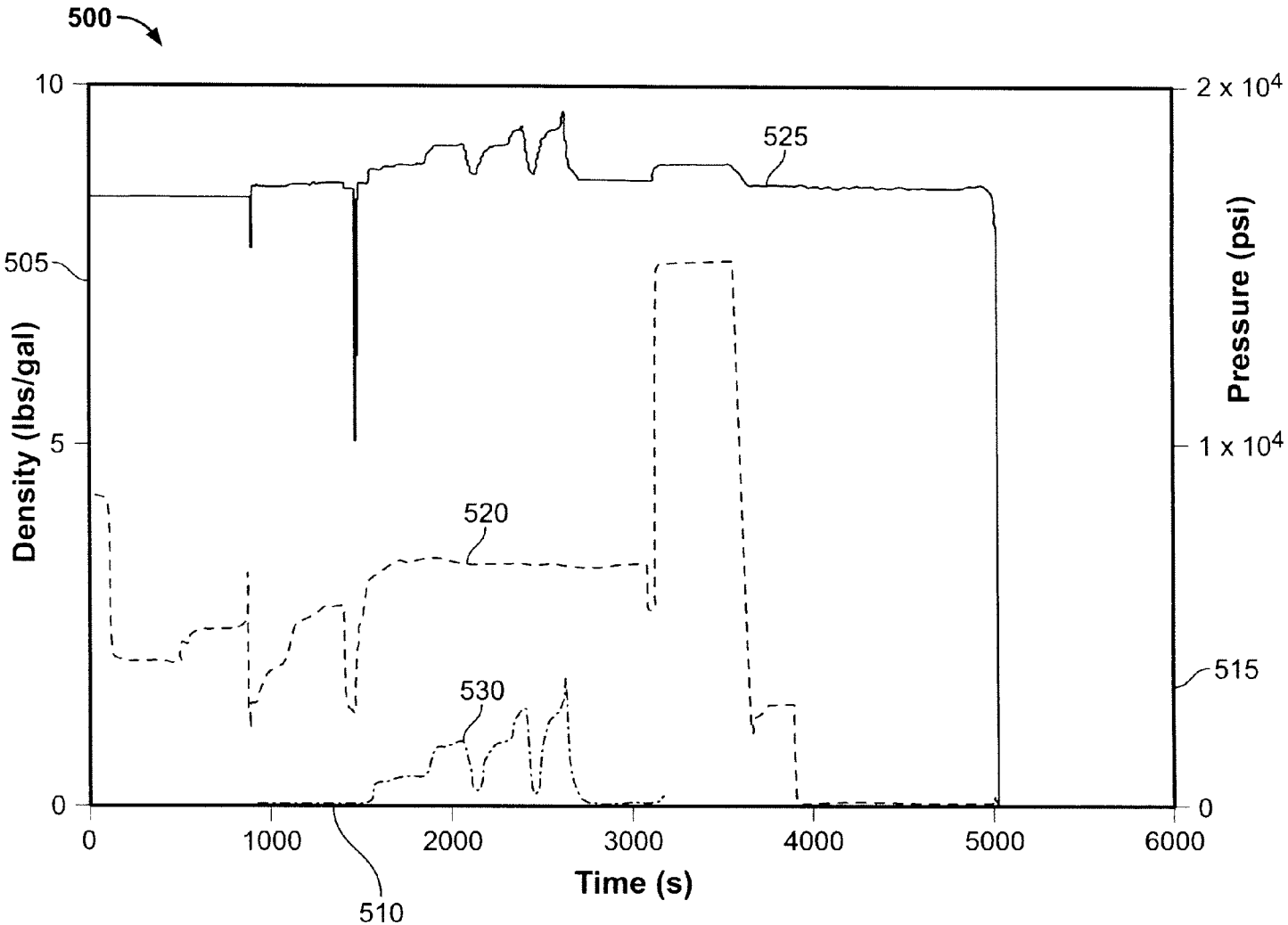
FIGS. 4-10 illustrate example graphical representations of one method of utilizing a densometer to determine a wellbore fluid pressure in accordance with the present disclosure.

Turning briefly to FIG. 4, an example graphical representation of a plurality of densometer values 520 is represented on graph 500. Graph 500 has vertical axis 505 representing a density of the fluid 162 in pounds per gallon (lbs/gal), a vertical axis 515 representing a pressure of the fluid 162 in pounds per square inch (psi), and a horizontal axis 510 representing a time in seconds (sec) during which the fluid 162 is pumped through the tubing system 150. As illustrated, the densometer values 520 are plotted over approximately 5000 sec and represent the densometer signals 270 measured and transmitted from the densometer 160. FIG. 4 also illustrates a corresponding plurality of fluid pressure values 525 plotted over the same time duration. The fluid pressure values 525 represent those received from a pressure transducer measuring the fluid pressure of fluid 162. For purposes of the present disclosure, the fluid pressure values 525 (and other fluid pressure values plotted in FIGS. 5-8) are shown to illustrate the correlation between density values 520 and fluid pressure. For instance, as illustrated in FIG. 4, while the density values 520 do not trace the fluid pressure values 525 exactly, they do share some similar features. In some aspects, the density values 520 are identical to the values of the densometer signals 270 stored in the memory 260. Graph 500 also includes a plot of the concentration 530 of the solids source 200 (e.g., proppant) in lbs/gal.

Returning to FIG. 3, the signals 270 can be corrected to account for a solid concentration within the fluid 162 at step 304. For example, the fluid 162 may include solid particulate, such as the solids source 200 (e.g., proppant). In certain instances, the density of the fluid 162 may be different (e.g., higher) if the solids source 200 is introduced therein. Thus, the density values 520 illustrated in FIG. 4 may be corrected according to, for example, the characteristics or concentration of the solids source 200 included in the fluid 162.

Figure 5:
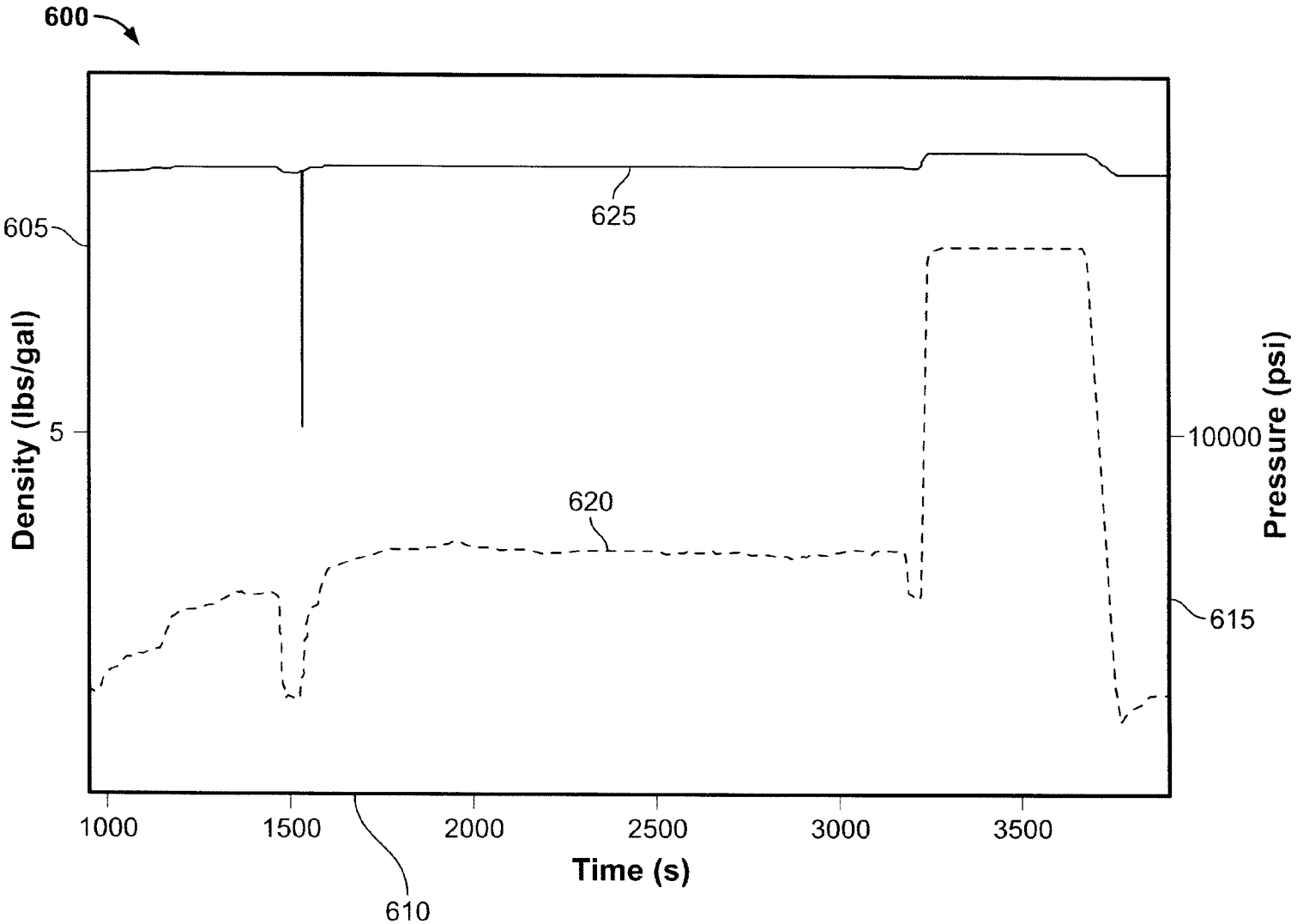

Correction of the densometer signals 270 (i.e., density values 520) by the concentration 530 of the solids source 200 may be accomplished by a corrective equation applied to the values 520. For example, the following Equation 1 may be applied:

$$\rho_{fluid} = C_{prop}\left[\rho_{slurry}\left(\frac{1}{\rho_{prop}} + \frac{1}{C_{prop}}\right) - 1\right]. \quad \text{Eq. 1}$$

where $\rho_{fluid}$ is the corrected density of the fluid 162 (illustrated as corrected density values 620 in FIG. 5); $C_{prop}$ is the concentration of the solids source 200 (e.g., proppant) in lbs of solid per gallon of fluid 162; $\rho_{prop}$ is the absolute density of the solids source 200; and $\rho_{slurry}$ is the density of the fluid 102 (i.e., density values 520). In some embodiments, it may be assumed for purposes of Equation 1 that the solids source 200 is relatively incompressible in comparison to fluid 162. Alternatively, a second correction may be made to account for the true compressibility of the solids source 200.

Turning now to FIG. 5, a graph 600 shows the corrected density values 620 after Equation 1 is applied to the density values 520 of FIG. 4. Graph 600 includes vertical axis 605 representing a density of the fluid 162 in lbs/gal, a vertical axis 615 representing a pressure of the fluid 162 in psi, and a horizontal axis 610 representing a time in sec during which the fluid 162 is pumped through the tubing system 150. As illustrated, once corrected, the density values 620 begin to more closely resemble the plot shape of the fluid pressure values 625. In some embodiments, the corrected density values 620 may be stored in memory 260 as corrected density values 275.

Returning to FIG. 3, whether or not the density values 520 are corrected fbr the solids concentration at step 310, the fluid pressure values can be corrected at step 306. For example, the fluid pressure values can he empirically derived from density values (such as density values 520 or corrected density values 620) or quantitatively derived from density values (such as density values 520 or corrected density values 620).

In some embodiments, the empirical correction may be performed to empirically match the density values 520 or 620 to known fluid pressure values of the fluid 162 as measured by a known working pressure transducer within a fluid pressure range measurable by the transducer. In some embodiments, such empirical derivation may be specific to the particular combination of densometer and pressure transducer. For example, each particular combination of densometcr and pressure transducer may generate a unique empirical correction equation, such as, for instance, Equation 2 shown below:

$$P = C_1 * \rho_{fluid}^3 - C_2 \quad \text{Eq. 2}$$

where P is the empirically corrected fluid pressure value; $\rho_{fluid}$ is the density values of the fluid 162 (such as density values 520 or density values 620); and $C_1$ and $C_2$ are empirically derived constants determined by a curve fit process of the density values to measured fluid pressure values. In the illustrated embodiment, $C_1$ equals 185.27 and $C_2$ equals 113450.

Figure 6:
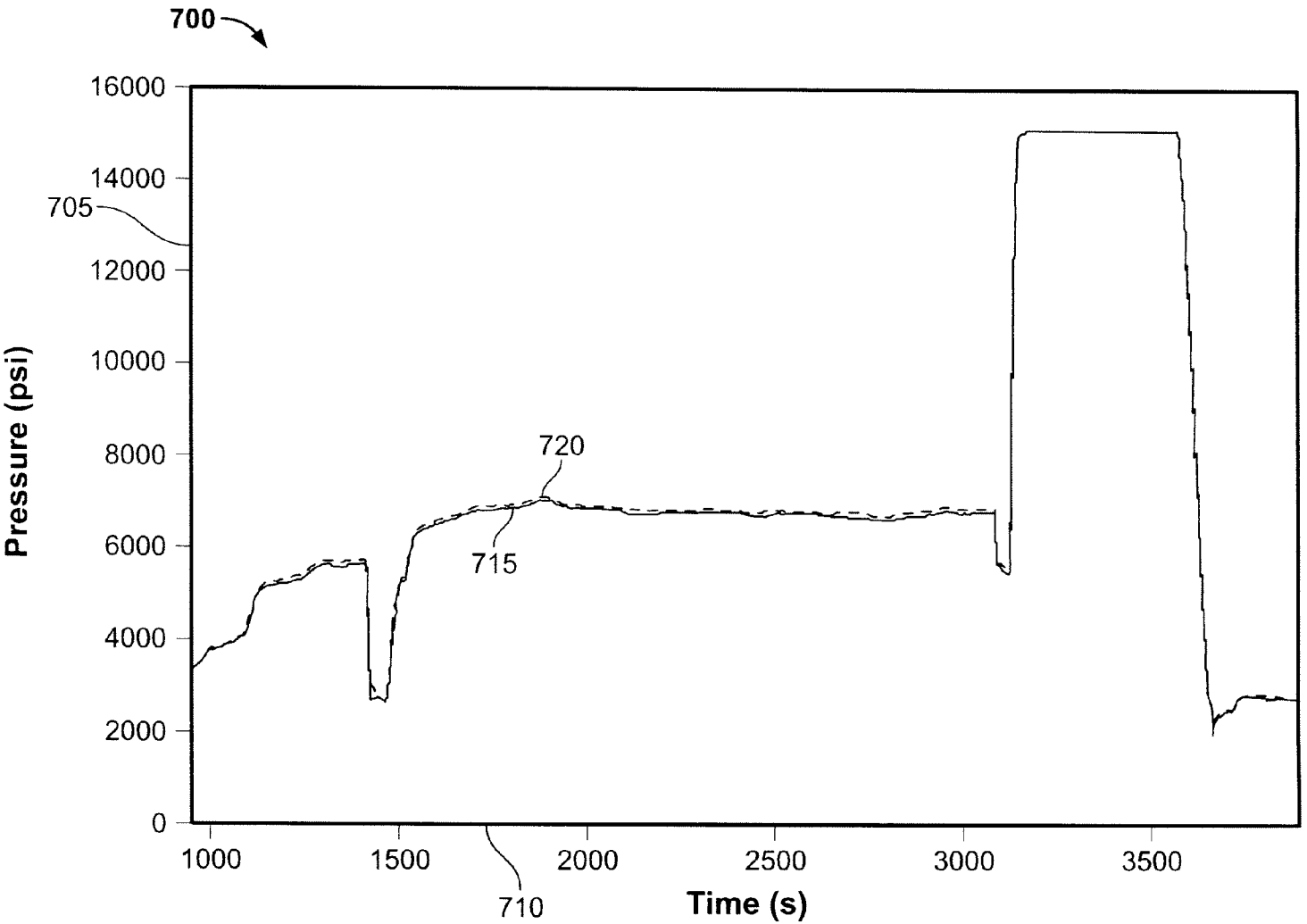

Turning to FIG. 6, a graph 700 illustrates the empirically corrected fluid pressure values 715 (P). Graph 700 includes vertical axis 705 representing a pressure of the fluid 162 in psi and a horizontal axis 710 representing a time in sec during which the fluid 162 is pumped through the tubing system 150. As illustrated, the empirically derived fluid pressure values 715 are substantially similar to the fluid pressure values 720 measured by the calibrated pressure transducer, showing that the pressure values 715 derived from the densometer signals 270 match (exactly or substantially) the true pressure values of the fluid 162. In some embodiments, the pressure values 715 may be stored as the empirically derived pressure values 280 in the memory 260.

Figure 7:
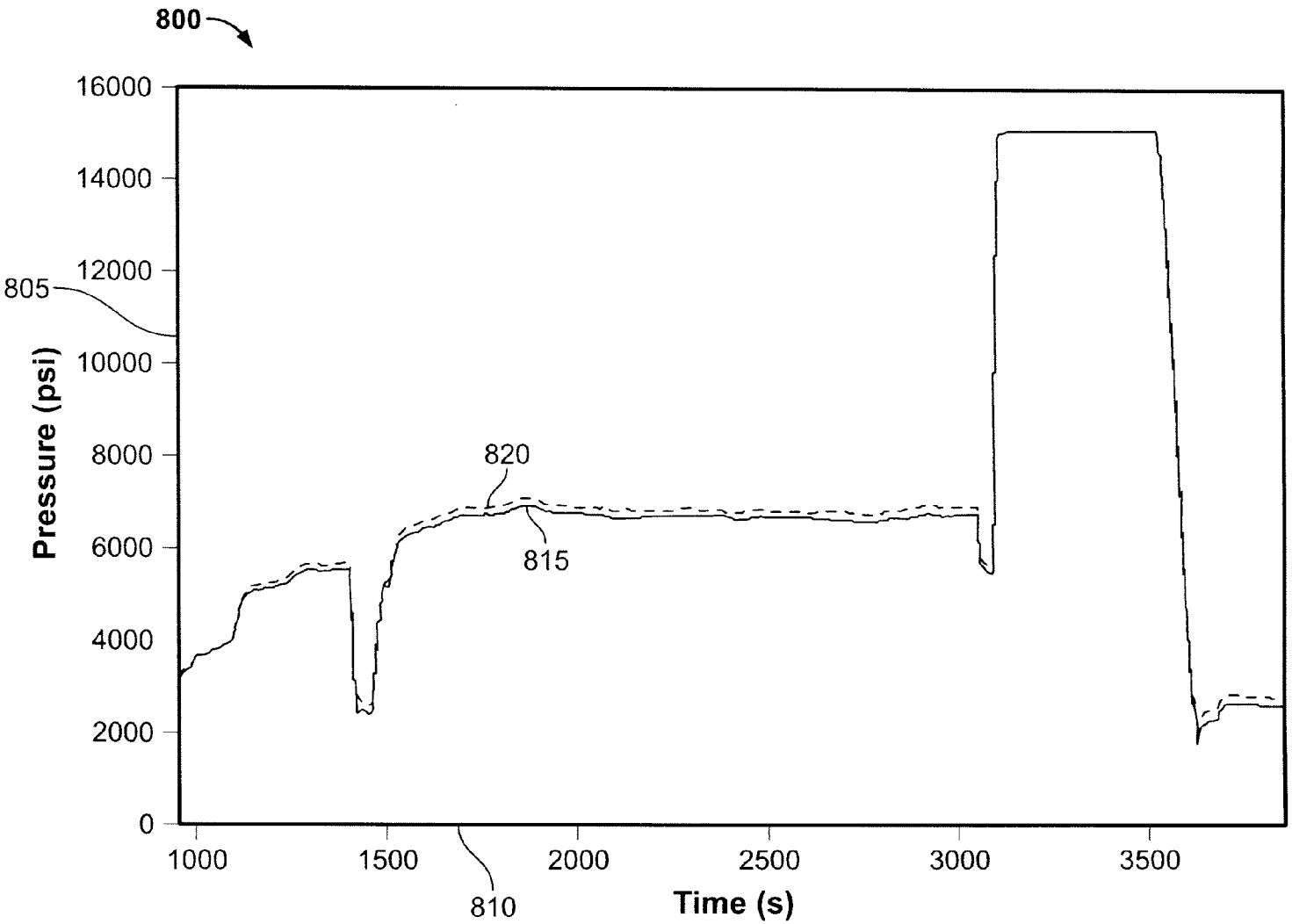

Returning to FIG. 3, if the determination is made to quantitatively derive the pressure values, then the density values 520 or 620 may be scaled quantitatively to correct the signals at step 306. For example, one or more equations may be applied to quantitatively derive the pressure values from density values. For instance, the relationship between fluid pressure and fluid density may be based on such fluid's bulk modulus, β, according to Equation 3:

$$\beta = -V\frac{dP}{d\rho} \quad \text{Eq. 3}$$

where V is system volume (e.g., the volume of the tubing system 150); P is pressure; and ρ is fluid pressure. Equation 3 may be rearranged for a closed volume system to Equation 4:

$$P = \beta\left(1 - \frac{\rho_1}{\rho_2}\right) \quad \text{Eq. 4}$$

where $\rho_1$ is the density of the fluid with zero system gauge pressure and $\rho_2$ is the instant fluid density. Equation 4 may be rewritten to account for sensor and calibration errors and curve fit to the measured fluid pressure by the pressure transducer by applying a gain factor constant, m, and an offset constant, b, according to Equation 5:

$$P = m * \beta\left(1 - \frac{\rho_1}{\rho_2}\right) + b \quad \text{Eq. 5}$$

where P is the fluid pressure quantitatively derived from the density values (e.g. density values 520 or 620). Turning to FIG. 7, graph 800 illustrates the quantitatively corrected fluid pressure values 815 (P). Graph 800 includes vertical axis 805 representing a pressure of the fluid 162 in psi and a horizontal axis 810 representing a time in sec during which the fluid 162 is pumped through the tubing system 150. As illustrated, the quantitatively derived fluid pressure values 815 are substantially similar to the fluid pressure values 820 measured by the calibrated pressure transducer, showing that the pressure values 815 derived from the densometer signals 270 match (exactly or substantially) the true pressure values of the fluid 162. In some embodiments, the pressure values 815 may be stored as the quantitatively scaled pressure values 285 in the memory 260.

Returning to FIG. 3, at step 308, the derived pressure values (e.g., empirically corrected fluid pressure values 715 or quantitatively corrected fluid pressure values 815) may be presented to a user, such as through a display peripheral 290. In addition to the illustrated steps of method 300, other steps may be performed in or in conjunction with method 300. For example, corrected density values, densometer signals, and/or derived pressure values may be stored or persisted at anytime during implementation of method 300 or subsequent to method 300. Such data may be stored in memory 260 or other memory, such as a memory located at a remote monitoring station (e.g., a station remote to the wellsite or a station at the wellsite remote from, for example, the truck 185). In addition, all, some, or none of such values may be communicated to the remote monitoring station during or subsequent to method 300. Accordingly, while method 300 illustrates one example method of operation, additional or fewer steps to those illustrated in FIG. 3 may be implemented. In addition, the steps illustrated in method 300 may be performed in a different order than that shown without departing from the scope of the present disclosure.

Figure 8:
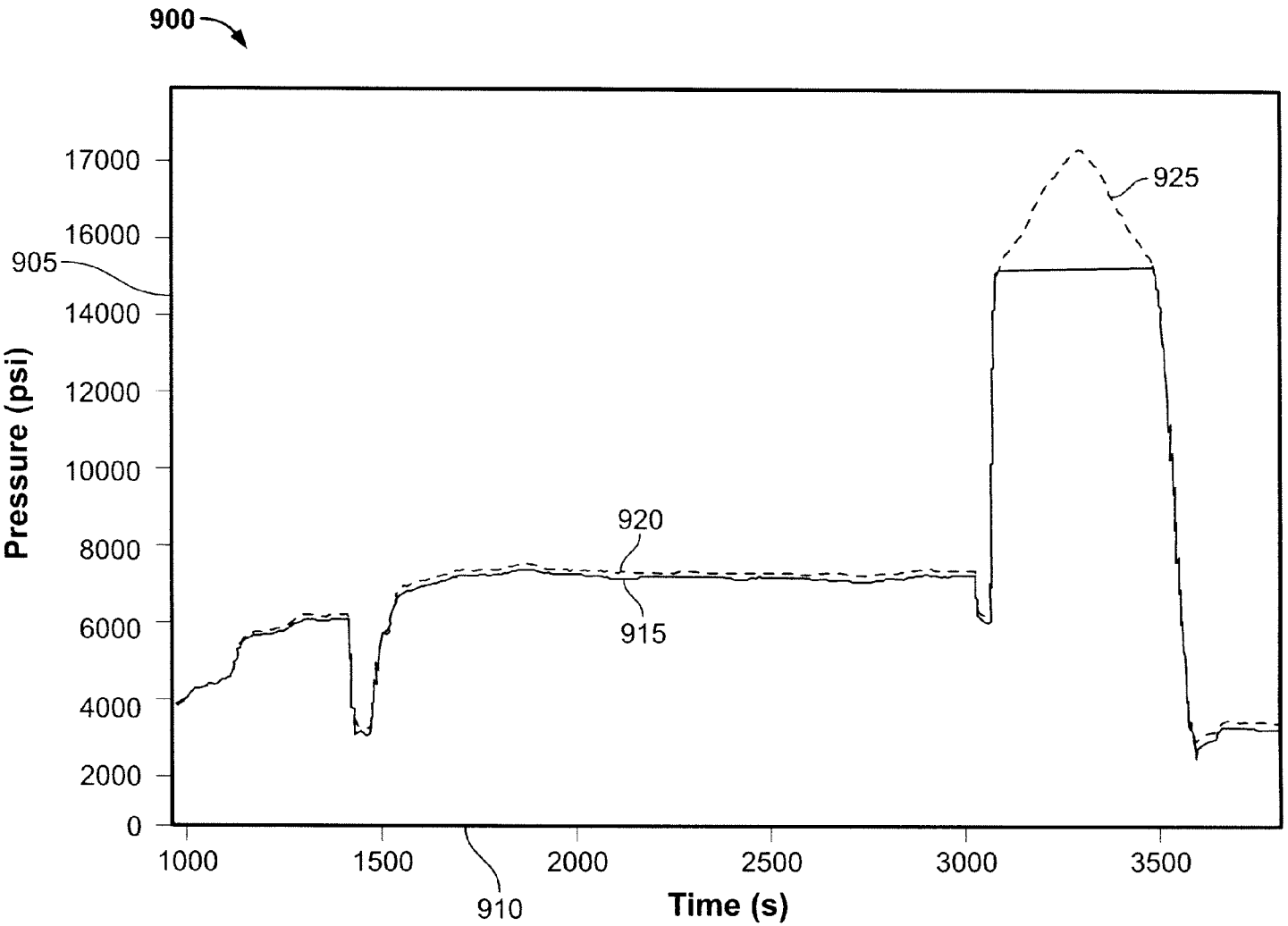

Turning to FIG. 8, graph 900 illustrates one implementation of method 500 in which a plot of derived pressure values 915 exceeds measured pressure values 920 within a particular time duration. Graph 900 includes vertical axis 905 representing a pressure of the fluid 162 in psi and a horizontal axis 910 representing a time in sec during which the fluid 162 is pumped through the tubing system 150. More particularly, graph 900 includes the derived pressure values 915 plotted over approximately 4000 seconds. Derived pressure values 915 may be empirically derived pressure values (such as values 720) or quantitatively derived pressure values (such as values 820). Measured pressure values 920 may, in some aspects, be fluid pressure values of fluid 162 measured by a pressure transducer.

As illustrated in FIG. 8, the derived pressure values 915 include a peak 925 that exceeds the measured pressure values 920 between approximately 3100 and 3600 seconds. As such, the peak 925 may represent a time duration in which the fluid pressure of fluid 162 exceeds a maximum rating of the pressure transducer. For example, the pressure transducer may have a maximum rating of approximately 16,000 psi. Thus, the measured pressure values 920 may not measure above such a rating. Alternatively, the pressure transducer measuring the pressure values 920 may have experienced a malfunction between 3100 and 3600 seconds, thereby providing an erroneous flatline reading. The derived pressure values 915, which are derived from densometer sigals (such as signals 270) measured by a densometer (such as densometer 160) located in, for example, tubing system 150, may provide a more accurate and/or reliable measurement of the fluid pressure of fluid 162.

Upon a determination that the peak 925 of the derived pressure values 920 exceeds measured pressure values 920, an operator (such as an operator of a frac job) may take a variety of remedial actions. For instance, if the derived pressure values 925 are determined in real time (e.g., during a frac job, or cement job, other completion operation, or drilling operation), the user may choose to shut down various fluid management equipment, such as, for example, pump 165. Alternatively, the user may choose to throttle such equipment, such as the valve 155 and/or the pump 165. In other embodiments, if the derived pressure values 925 are determined subsequent to an operation (e.g., after a frac job, or cement job, other completion operation, or drilling operation), the values 925 may be evaluated to determine if a maximum fluid pressure rating of any such components has been approached or exceeded. As just one example, if a component of the tubing system 150 (e.g., valves 190 or valve 155 or other component) has a maximum pressure rating of 16,000 psi, the derived pressure values 915 (and peak 925) may indicate to an operator that such rating had been exceeded, thereby allowing the operator to replace, repair, and/or test such component. As illustrated, the operator may not have been provided such an indication merely from the measured pressure values 920.

Figure 9:
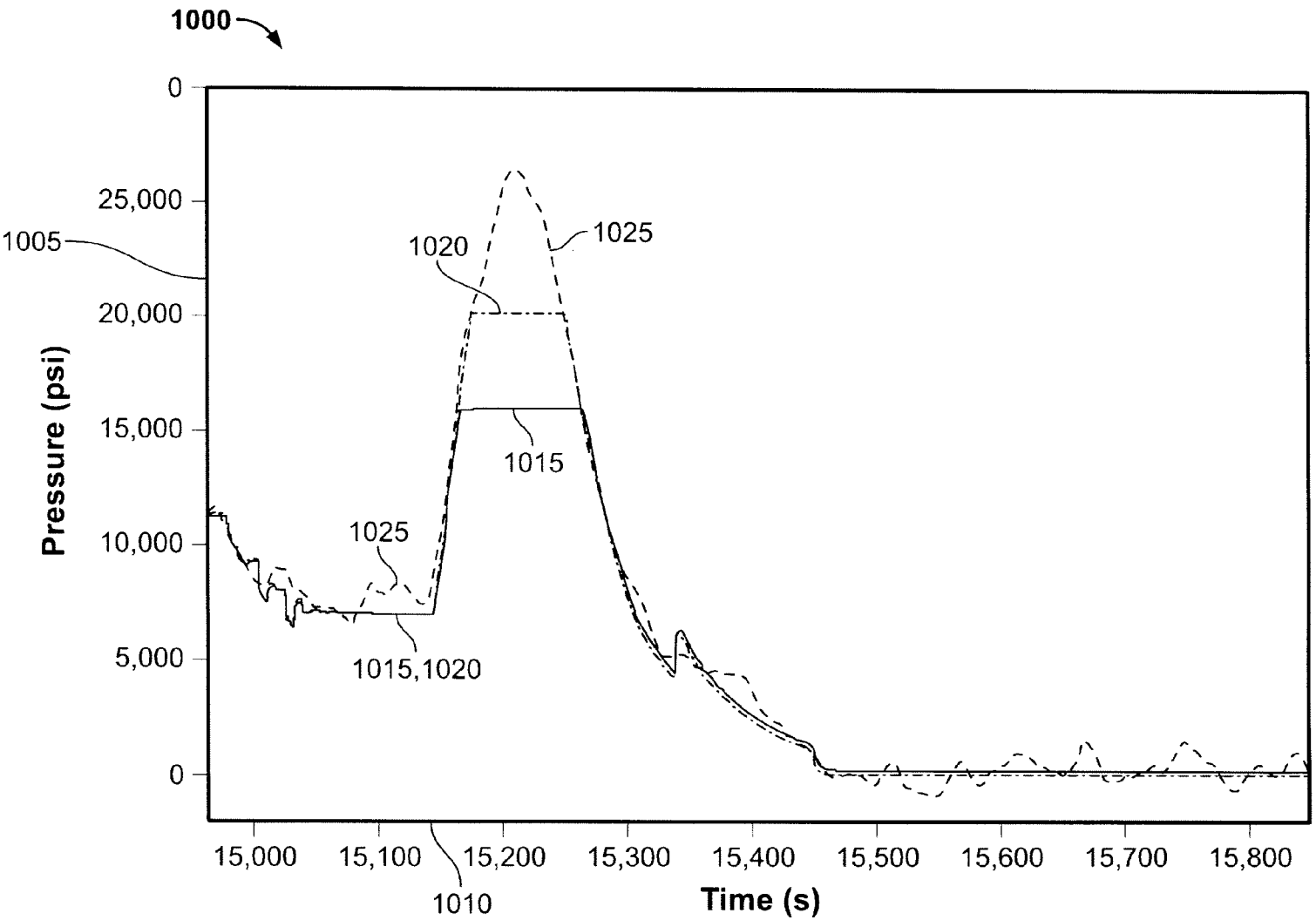

Turning to FIG. 9, graph 1000 illustrates one graphical representation of an instance where an active pressure transducer may be ineffective due to being in an over-ranged condition during a pressure spike. Such ineffectiveness may be compensated for by determining fluid pressure through signals received by a densometer. For example, graph 1000 illustrates a plot of a wellhead pressure transducer 1015, a plot of a pump pressure transducer 1020, and a plot of pressure values derived from densometer signals 1025. Graph 1000 includes vertical axis 1005 representing a pressure of the monitored fluid in psi and a horizontal axis 1010 representing a time in sec during which the fluid is pumped through the system including the wellhead, pump, and densometer. The derived pressure values 1025 may be empirically derived pressure values or quantitatively derived pressure values.

As illustrated, the plot of the wellhead transducer 1015 maxed at approximately 15K psi, indicative of the maximum rating of the wellhead transducer. The plot of the pump transducer 1020 maxed at approximately 20K psi, indicative of the maximum rating of the pump transducer. The plot of derived pressure values from the densometer 1025, however, illustrated the pressure spike at over 25K psi, illustrating an overpressure scenario undetected by the wellbore and pump pressure transducers. In such a scenario, one or more remedial actions (e.g., replacement and/or repair of the wellhead, pump, or other components; system pressure testing; or other action) may be taken.

Figure 10:
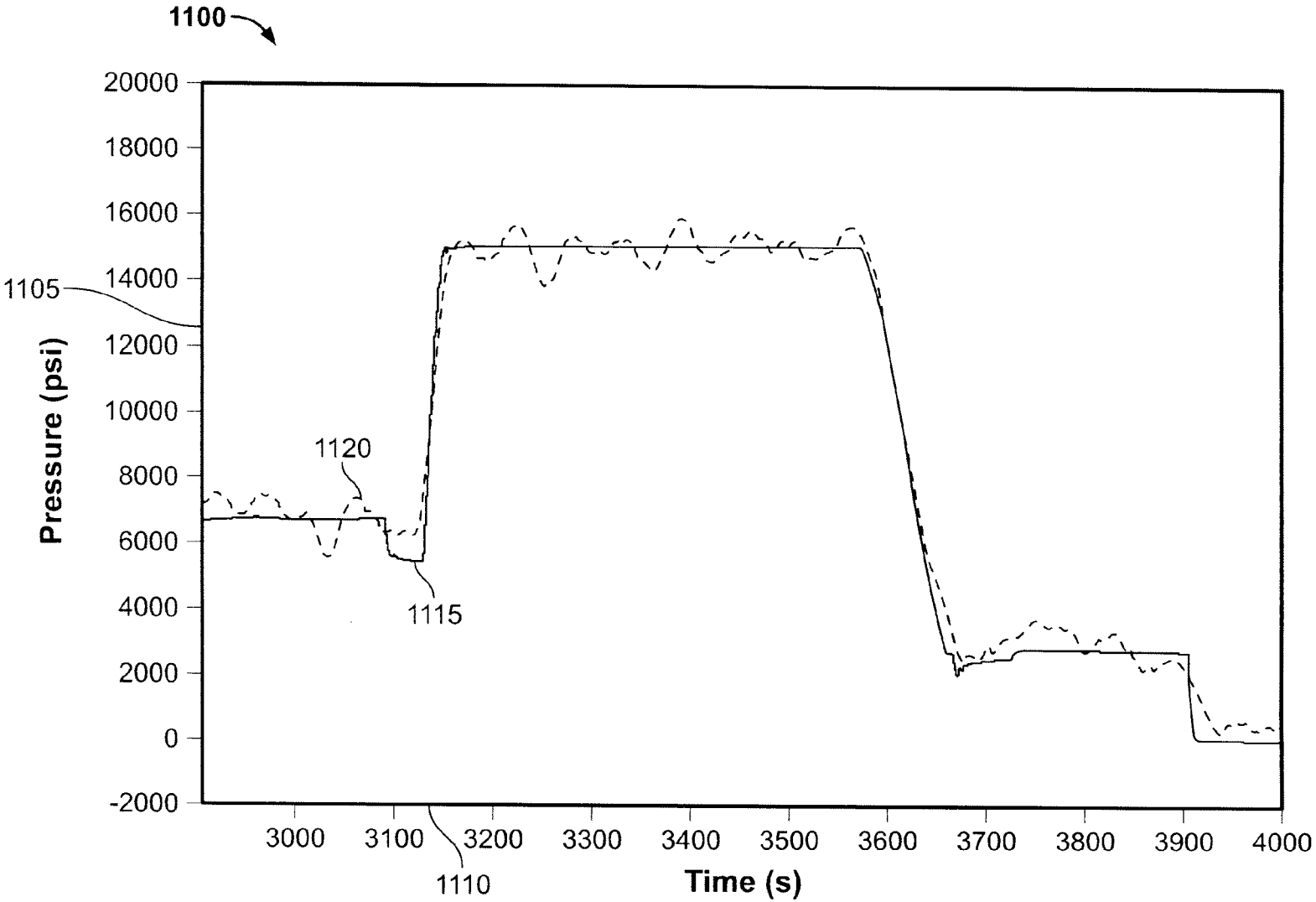

Turning to FIG. 10, graph 1100 illustrates one graphical representation of an instance where an active pressure transducer (i.e., a wellhead transducer) was suspected of being over-ranged by a pressure spike event. For example, graph 1100 illustrates a plot of a wellhead pressure transducer 1115 and a plot of pressure values derived from densometer signals 1120. Graph 1100 includes vertical axis 1105 representing a pressure of the monitored fluid in psi and a horizontal axis 1110 representing a time in sec during which the fluid is pumped through the system including the wellhead and densometer. The derived pressure values 1020 may be empirically derived pressure values or quantitatively derived pressure values.

As illustrated, the plot of derived pressure values from the densometer 1120, remain consistent with the plot of the wellhead transducer 1115, showing that the fluid pressure did not exceed the maximum rating of the wellhead transducer even though, as shown, the plot of the wellhead pressure 1115 appeared to flatline at its maximum rating (15K psi). Therefore, well operators may confirm that the wellhead can operate normally and does not need to be replaced and/or repaired.

A number of embodiments have been described. Nevertheless, it will be understood that various modifications may be made. For example, other equations besides those example equations described herein may be used to relate signals from a densometer to fluid pressure. As another example, the techniques and systems described herein may be applied to surface equipment (e.g., pumping equipment, piping, conduit, or otherwise) as well as wellbore components, such as tubing. As yet another example, just as densometer signals may be corrected according to an amount of solids (e.g., proppant) in the fluid, the densometer signals may also be corrected to account for changes in the composition of a base fluid (e.g., gel source 195, liquid source 220, or other fluid) which might affect density may also be corrected for, whether by calculation and knowledge of fluid properties or by other measurement techniques. For example, an additional densometer may be installed in a low pressure fluid line and the output thereof may he compared to an output from a densometer installed in a high pressure line. Such a technique may also be utilized to correct for solid concentration. Accordingly, other embodiments are within the scope of the following claims.

What is claimed is:

1. A computer implemented method of determining a wellbore fluid pressure, the method comprising:

receiving, at a computer, a signal from a densometer representative of a density of a fluid flowing through a wellbore, the fluid comprising a slurry having a fluid component and a solid component;

determining, by the computer, a fluid pressure of the fluid based at least in part on the signal;

correcting the signal representative of the fluid density based on a concentration of the solid component in the slurry;

empirically scaling the corrected signal representative of the fluid density to determine the fluid pressure of the fluid by scaling the corrected signal representative of the fluid density as a function of the fluid density and one or more empirically derived constants according to the equation:

$$P = m * \beta\left(1 - \frac{\rho_1}{\rho_2}\right) + b$$

where P is the determined fluid pressure of the fluid, $\rho_1$ is a density of the fluid with zero system gauge pressure, $\rho_2$ is an instant fluid density, m is a gain factor constant, $\beta$ is a bulk modulus of the fluid, and b is an offset constant; and quantitatively scaling the corrected signal representative of the fluid density to determine the fluid pressure of the fluid.

2. The method of claim 1, the signal comprising a plurality of values representative of the density of the fluid, and wherein determining, by the computer, a fluid pressure of the fluid based at least in part on the signal comprises determining, by the computer, a fluid pressure of the fluid based on at least a portion of the values representative of the density of the fluid.

3. The method of claim 1, wherein correcting the signal representative of the fluid density based on a concentration of the solid component in the slurry comprises correcting the signal representative of the fluid density based on the equation $$\rho_{fluid} = C_{prop}\left[\rho_{slurry}\left(\frac{1}{\rho_{prop}} + \frac{1}{C_{prop}}\right) - 1\right]$$

where $\rho_{fluid}$ is the corrected signal representative of the fluid density; $C_{prop}$ is the concentration of the solid component in the slurry in lbs of solid per gallon of fluid; $\rho_{prop}$ is an absolute density of the solid component in the slurry; and $\rho_{slurry}$ is a density of the fluid.

4. The method of claim 1, wherein one or both of $C_1$ and $C_2$ are determined based at least in part on a combination of a particular densometer and a particular pressure transducer.

5. The method of claim 1, further comprising:

comparing the fluid pressure to a predefined pressure; and determining that the fluid pressure exceeds the predefined pressure; and initiating a remedial action based at least in part on the determination that the fluid pressure exceeds the predefined pressure.

6. The method of claim 5, wherein initiating a remedial action based at least in part on the determination that the fluid pressure exceeds the predefined pressure comprises at least one of:

setting an alarm indicating that the fluid pressure exceeds the predefined pressure; and stopping one or more pumping units providing at least a portion of the fluid to the wellbore.

7. A computer implemented method of determining a wellbore fluid pressure, the method comprising:

receiving, at a computer, a signal from a densometer representative of a density of a fluid flowing through a wellbore, the fluid comprising a slurry having a fluid component and a solid component;

determining, by the computer, a fluid pressure of the fluid based at least in part on the signal;

correcting the signal representative of the fluid density based on a concentration of the solid component in the slurry;

empirically scaling the corrected signal representative of the fluid density to determine the fluid pressure of the fluid; and quantitatively scaling the corrected signal representative of the fluid density to determine the fluid pressure of the fluid by scaling the corrected signal representative of the fluid density according to a value representing a bulk modulus of the fluid.

8. The method of claim 7, wherein the value representing the bulk modulus of the fluid comprises a non-linear value representing the bulk modulus of the fluid.

9. The method of claim 8, wherein quantitatively scaling the corrected signal representative of the fluid density to determine the fluid pressure of the fluid comprises scaling the corrected signal according to the equation:

$$P = m * \beta\left(1 - \frac{\rho_1}{\rho_2}\right) + b$$

where P is the determined fluid pressure of the fluid, $\rho_1$ is a density of the fluid with zero system gauge pressure, $\rho_2$ is an instant fluid density, m is a gain factor constant, $\beta$ is a bulk modulus of the fluid, and b is an offset constant.

10. The method of claim 7 further comprising:

comparing the fluid pressure to a predefined pressure; and determining that the fluid pressure exceeds the predefined pressure; and initiating a remedial action based at least in part on the determination that the fluid pressure exceeds the predefined pressure.

11. The method of claim 10, wherein initiating a remedial action based at least in part on the determination that the fluid pressure exceeds the predefined pressure comprises at least one of :

setting an alarm indicating that the fluid pressure exceeds the predefined pressure; and stopping one or more pumping units providing at least a portion of the fluid to the wellbore.

12. A computer program product for determining a wellbore fluid pressure, the computer program product comprising computer readable instructions embodied on non-transitory tangible media that are operable when executed to perform operations comprising:

receiving a signal from a densometer representative of a density of a fluid flowing through a wellbore, the fluid comprising a slurry having a fluid component and a solid component;

determining a fluid pressure of the fluid based at least in part on the signal;

correcting the signal representative of the fluid density based on a concentration of the solid component in the slurry;

empirically scaling the corrected signal representative of the fluid density to determine the fluid pressure of the fluid; and quantitatively scaling the corrected signal representative of the fluid density to determine the fluid pressure of the fluid by scaling the corrected signal representative of the fluid density according to a value representing a bulk modulus of the fluid.

13. The computer program product of claim 12, the signal comprising a plurality of values representative of the density of the fluid, and wherein determining a fluid pressure of the fluid based at least in part on the signal comprises determining a fluid pressure of the fluid based on at least a portion of the values representative of the density of the fluid.

14. The computer program product of claim 12, the value representing the bulk modulus of the fluid comprises a non-linear value representing the bulk modulus of the fluid.

15. The computer program product of claim 12, wherein quantitatively scaling the corrected signal representative of the fluid density to determine the fluid pressure of the fluid by scaling the corrected signal representative of the fluid density according to a value representing a bulk modulus of the fluid comprises scaling the corrected signal according to the equation:

$$P = m * \beta\left(1 - \frac{\rho_1}{\rho_2}\right) + b,$$

where P is the determined fluid pressure of the fluid, $\rho_1$ is a density of the fluid with zero system gauge pressure, $\rho_2$ is an instant fluid density, m is a gain factor constant, $\beta$ is the bulk modulus of the fluid, and b is an offset constant.

16. The computer program product of claim 12, wherein the operations further comprise:

comparing the fluid pressure to a predefined pressure; and determining that the fluid pressure exceeds the predefined pressure; and initiating a remedial action based at least in part on the determination that the fluid pressure exceeds the predefined pressure.

17. The computer program product of claim 16, wherein initiating a remedial action based at least in part on the determination that the fluid pressure exceeds the predefined pressure comprises at least one of:

setting an alarm indicating that the fluid pressure exceeds the predefined pressure; and stopping one or more pumping units providing at least a portion of the fluid to the wellbore.

18. A wellbore fluid pressure measurement system comprising:

a densometer adapted to measure a fluid density of a fluid flowing in a tubing system; and a monitoring unit communicably coupled to the densometer, the monitoring unit adapted to receive a plurality of values representative of the fluid density from the densometer, the monitoring unit comprising:

a memory adapted to store the plurality of values representative of the fluid density; and one or more processors operable to execute a fluid pressure measurement module, the module operable when executed to:

determine a fluid pressure of the fluid based on at least a portion of the values representative of the fluid density;

empirically scale the portion of the values representative of the fluid density to determine the fluid pressure of the fluid; and quantitatively scale the portion of the values representative of the fluid density to determine the fluid pressure of the fluid by scaling the portion of the values representative of the fluid density by an equation comprising a value representing a bulk modulus of the fluid.

19. The system of claim 18, the fluid pressure measurement module further operable when executed to correct the plurality of values based on a solid content concentration of the fluid.

20. The system of claim 18, wherein the value representing the bulk modulus of the fluid comprises a non-linear value representing the bulk modulus of the fluid.

21. The system of claim 20, the module further operable when executed to scale the corrected signal according to the equation:

$$P = m * \beta\left(1 - \frac{\rho_1}{\rho_2}\right) + b,$$

where P is the determined fluid pressure of the fluid, $\rho_1$ is a density of the fluid with zero system gauge pressure, $\rho_2$ is an instant fluid density, m is a gain factor constant, β is the bulk modulus of the fluid, and b is an offset constant.

22. The system of claim 18, the module further operable when executed to:

compare the fluid pressure to a predefined pressure; and determine that the fluid pressure exceeds the predefined pressure; and initiate a remedial action based at least in part on the determination that the fluid pressure exceeds the predefined pressure.

23. The system of claim 22, wherein the module is further operable when executed to initiate the remedial action based at least in part on the determination that the fluid pressure exceeds the predefined pressure by performing at least one of:

setting an alarm indicating that the fluid pressure exceeds the predefined pressure; and stopping one or more pumping units providing at least a portion of the fluid to the wellbore.

24. A wellbore fluid pressure measurement system comprising:

a densometer adapted to measure a fluid density of a fluid flowing in a tubing system; and a monitoring unit communicably coupled to the densometer, the monitoring unit adapted to receive a plurality of values representative of the fluid density from the densometer, the monitoring unit comprising:

a memory adapted to store the plurality of values representative of the fluid density; and one or more processors operable to execute a fluid pressure measurement module, the module operable when executed to:

determine a fluid pressure of the fluid based on at least a portion of the values representative of the fluid density;

empirically scale the portion of the values representative of the fluid density to determine the fluid pressure of the fluid by curve fitting the portion of the values representative of the fluid density to a curve representing measured fluid pressure values; and quantitatively scale the portion of the values representative of the fluid density to determine the fluid pressure of the fluid.

25. The system of claim 24, wherein the module is further operable when executed to quantitatively scale the corrected signal according to the equation:

$$P = m * \beta\left(1 - \frac{\rho_1}{\rho_2}\right) + b$$

where P is the determined fluid pressure of the fluid, $\rho_1$ is a density of the fluid with zero system gauge pressure, $\rho_2$ is an instant fluid density, m is a gain factor constant, β is a bulk modulus of the fluid, and b is an offset constant.

26. The system of claim 24, wherein the module is further operable when executed to:

compare the fluid pressure to a predefined pressure; and determine that the fluid pressure exceeds the predefined pressure; and initiate a remedial action based at least in part on the determination that the fluid pressure exceeds the predefined pressure.

27. The system of claim 26, wherein the module is further operable when executed to:

set an alarm indicating that the fluid pressure exceeds the predefined pressure; or stop one or more pumping units providing at least a portion of the fluid to the wellbore.

28. A computer program product for determining a wellbore fluid pressure, the computer program product comprising computer readable instructions embodied on non-transitory tangible media that are operable when executed to perform operations comprising:

receiving a signal from a densometer representative of a density of a fluid flowing through a wellbore, the fluid comprising a slurry having a fluid component and a solid component;

determining a fluid pressure of the fluid based at least in part on the signal;

correcting the signal representative of the fluid density based on a concentration of the solid component in the slurry;

empirically scaling the corrected signal representative of the fluid density to determine the fluid pressure of the fluid by scaling the corrected signal representative of the fluid density as a function of the fluid density and one or more empirically derived constants according to the equation:

$$P = C_1 * \beta_{fluid}^3 - C_2,$$

where P is the determined fluid pressure of the fluid; $\rho_{fluid}$ is the fluid density; and $C_1$ and $C_2$ are empirically derived constants; and quantitatively scaling the corrected signal representative of the fluid density to determine the fluid pressure of the fluid.

29. The computer program product of claim 28, the signal comprising a plurality of values representative of the density of the fluid, and wherein determining a fluid pressure of the fluid based at least in part on the signal comprises determining a fluid pressure of the fluid based on at least a portion of the values representative of the density of the fluid.

30. The computer program product of claim 28, wherein correcting the signal representative of the fluid density based on a concentration of the solid component in the slurry comprises correcting the signal representative of the fluid density based on the equation $$\rho_{fluid} = C_{prop}\left[\rho_{slurry}\left(\frac{1}{\rho_{prop}} + \frac{1}{C_{prop}}\right) - 1\right],$$

where $\rho_{fluid}$ is the corrected signal representative of the fluid density; $C_{prop}$ is the concentration of the solid component in the slurry in lbs of solid per gallon of fluid; $\rho_{prop}$ is an absolute density of the solid component in the slurry; and $\rho_{slurry}$ is a density of the fluid.

31. The computer program product of claim 28, wherein one or both of $C_1$ and $C_2$ are determined based at least in part on a combination of a particular densometer and a particular pressure transducer.

* * * * *